US005926876A

United States Patent [19]

Haigh et al.

[11] Patent Number: 5,926,876

[45] **Date of Patent: *Jul. 27, 1999**

[54] SURGICAL OPERATING TABLE ACCESSORY FOR SHOULDER PROCEDURES

[75] Inventors: James H. Haigh; Alfredo M. Choperena, both of Eden Prairie, Minn.

[73] Assignee: Compacta International, Ltd., Eden Prairie, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/754,512

[22] Filed: Nov. 19, 1996

[51] Int. Cl.[6] ..... A47C 20/04

[52] U.S. Cl. ..... 5/617; 5/616; 5/634; 5/635

[58] Field of Search ..... 5/607, 612, 613, 5/616, 617, 621, 622, 630, 632, 633, 634, 635

[56] References Cited

U.S. PATENT DOCUMENTS

| | | | |
|---|---|---|---|
| 418,004 | 12/1889 | Frick | 5/633 |
| 503,969 | 8/1893 | Huddleston | 5/617 |
| 2,554,799 | 5/1951 | Sprunger | 5/632 |
| 2,788,529 | 4/1957 | Moritzacky et al. | 5/634 |
| 3,419,921 | 1/1969 | Flood | 5/634 |
| 4,185,342 | 1/1980 | Young | 5/634 |
| 4,458,370 | 7/1984 | Fickler | 5/617 |
| 4,616,814 | 10/1986 | Harwood-Nash et al. | 5/601 |
| 4,628,552 | 12/1986 | Magistretti | 5/617 |
| 4,651,365 | 3/1987 | Zeigler | 5/616 |
| 4,752,982 | 6/1988 | Jones et al. | 5/634 |
| 4,754,507 | 7/1988 | Edge | 5/633 |
| 4,970,735 | 11/1990 | Shankman | 5/55.1 |
| 5,381,565 | 1/1995 | Schmidt | 5/634 |

FOREIGN PATENT DOCUMENTS

| | | | |
|---|---|---|---|
| 662727 | 10/1987 | Switzerland | 5/634 |

OTHER PUBLICATIONS

"Captain's Chair Package", *Orthopedics,* Equipment #: BF33–800, p. 47, published prior to Nov. 19, 1996.

"Schlein Shoulder Positioner", *OSI,* Orthopedic Systems, Inc., Model No. 5336, 4 pages, Published prior to Nov. 19, 1996.

Stone, K.R., et al., "Acromioclavicular Joint Reconstruction Using Gore–Tex Tape Evaluation Of A New Surgical Technique And Rehabilitation Protocol", *Acromioclavicular Joint Reconstruction,* 5 pages, (Sep. 10, 1996).

*Primary Examiner*—Michael F. Trettel
*Assistant Examiner*—Robert G. Santos
*Attorney, Agent, or Firm*—Schwegman, Lundberg, Woessner & Kluth, P.A.

[57] ABSTRACT

A device for adapting a surgical operating table such that the upper torso of the patient can be raised in order to place the patient in a seated position, the device further providing the means of exposing or supporting a side of said patient's upper torso and limbs. The device contains a continuously adjustable positioning mechanism, and corresponding actuator for said mechanism, in a way that a user can rapidly and conveniently put a patient in the desired position, from a supine posture to a fully seated position. Additionally, the device does not render the surgical table permanently modifed, as the process of modification is reversible by means of a simple attachment mechanism. The device uses a back support section hingedly connected to a base frame, this base frame providing the attachment support to the surgical table. Side support panels are either moved out of the way on the patient's operative side, or left in place to provide support to the unaffected side. Two embodiments are described that differ solely in the way the back support surface is implemented.

41 Claims, 11 Drawing Sheets

SURGICAL OPERATING TABLE ACCESSORY FOR SHOULDER PROCEDURES

FIELD OF THE INVENTION

The present invention relates generally to devices used in conjunction with operating tables to facilitate the performance of certain surgical procedures on the human torso or upper limbs. In particular, this invention describes a device that allows a patient to be placed in a seated position, while providing access to all aspects of either shoulder, and allowing free movement of the arms.

BACKGROUND OF THE INVENTION

Orthopaedic surgical procedures, particularly shoulder arthroscopy, have continued to grow very rapidly. In North America, more than 150,000 procedures are performed yearly, mainly as a result of sports-related injuries. In the U.S. alone there are over 13,000 active, board-certified orthopaedic surgeons engaged in the full- or part-time practice of orthopaedic surgery. Of these, according to data from the American Academy of Orthopaedic Surgeons, more than 25% concentrate on shoulder and elbow procedures. This significant growth is mainly attributed to changes in the procedures themselves, the most significant being arthroscopic surgery. In the past, treatment of orthopaedic injuries involved extensive surgery, including large incisions, and a prolonged recovery period. With the help of an arthroscope, the orthopaedic surgeon can easily examine, diagnose, and treat problems in the joint that previously may have been difficult to identify.

Generally, shoulder procedures are performed with the patient under general anesthesia, lying in the lateral decubitus position, with the arm in traction to distend the shoulder joint. Such positioning and the application of such traction are generally shown in Pitman, et al., "The Use of Somatosensory Evoked Potentials for Detection of Neuropraxia During Shoulder Arthroscopy", Arthroscopy, Vol. 4, No. 4, 1988, pages 250–255, and in Klein, et al., "Measurement of Brachial Plexus Strain in Arthroscopy of the Shoulder", Arthroscopy, Vol. 3, No. 1, 1987, pages 45–52.

More recently, the advantages of performing shoulder procedures with the patient in the so called "Beach-Chair Position" have been covered extensively in the literature and at orthopaedic surgery congresses. For example, Stone, et al. described a procedure for acromioclavicular joint reconstruction and emphatically asserted their preference for all shoulder surgery with the patient in the beach-chair position. Furthermore, Grossfeld and Buss presented their procedure for arthroscopic evaluation of the glenohumeral joint in the beach chair position at the 1996 meeting of the American Academy of Orthopaedic Surgeons. With this way of positioning patients becoming the preference of orthopaedic surgeons, the importance of positioning devices has been raised to new levels.

Two choices exist for positioning patients in the beach-chair position, dedicated surgical tables that are factory made with the required mechanisms, and accessories to regular tables that adapt them as required. Briefly described, an operating table includes a seat support, a leg support, and a back support. The seat support extends generally horizontal for supporting the central torso of the patient. The leg support is hingedly connected to one end of the seat support. The back support is hingedly connected to the opposing end of the seat support for supporting the back and head of the patient. Normally, the three surfaces are independently adjustable by motorized or manual means and allow cushions or other attachments to be placed on them. Furthermore, operating tables are provided with a set of rails laterally connected to the adjustable surfaces, that allow attachment of accessories such as traction devices, intravenous solution bags, knee surgery rigs, etc.

Chandler, in U.S. Pat. No. 5,275,176 describes an operating table and method for shoulder arthroscopy, such table consisting of a leg support, a central support, and a back support that includes detachable modular shoulder cutouts to gain access to the posterior aspect of the shoulder. Using this device, the patient is first supported in a supine position, anesthetized, secured to the table, and the table is thereafter configured to a sitting position. One of the modular shoulder cutouts is then removed to provide access to the shoulder upon which arthroscopy is to be performed. The primary disadvantage of the Chandler device is that the operating table is factory configured with this feature. Thus, the large number of existing operating tables already in use can not be adapted to perform these procedures.

Another manufacturer, OSI of Union City, Calif. offers a shoulder positioner that adapts to operating tables. Although this device addresses the main disadvantage of the device described by Chandler, the OSI positioner limits the range of positioning from semi-seated to a reclining position of 45 degrees. The obvious disadvantage is the difficulty in transferring the patient to an operating table fitted with the OSI accessory, as such accessory does not lay in a flat position. Additionally, positioning flexibility is limited in the OSI device since it uses discrete fixed positions, as opposed to a more desirable continuous adjustment.

Another device made by AMSCO, an operating table manufacturer, attaches to the free end of the back support surface of an operating table. This configuration does not allow for continuous adjustment of the back and severely limits adjustment of the patient's lower extremities.

SUMMARY OF THE INVENTION

The present invention relates to an accessory to an operating table, that provides unlimited adjustment from a flat position, parallel to the operating table, to about eighty degrees relative to the table plane. The device consists of a base frame that mounts to any convenient point of the table, such as the side rails, and a three-part patient support surface, each part hingedly and independently connected to an end of the base frame. A center section of the support surface is also connected to the support frame by a continuously adjustable positioning mechanism, that allows positioning from zero to eighty degrees (respecting the base frame). Two other hinged, side support sections are either lockable onto the center section or independently moved away from it to provide posterior access to the patient's body. The present invention improves upon the state of the art by the use of a continuously adjustable positioning mechanism, by providing separate support sections that can act jointly or separately, by providing additional side rails for attaching additional accessories on the non-operative side, and by providing a transparent and non-destructive way of adapting or reconfiguring an operating table.

Normally an operating table has removable sections in its leg, seat and back support surfaces. The device of the present invention attaches readily to the side rails on the back support section after removal of the cushion surfaces. When attached to the operating table and in the closed position, the device provides a flat padded surface similar to that provided by the cushions normally supplied with the operating table.

A positioning mechanism allows the device to be opened, and the back support to be raised to any angle up to eighty degrees relative to its mounting plane. The positioning mechanism allows for infinite adjustment of the position angle while supporting the forces applied by the patient's weight and by the surgeon during the procedure.

Accordingly, an object of this invention is to provide an economical way of adapting a surgical operating table, in a way that the adaptation can be done at will and the table can continue to be used for other procedures. This invention has the primary advantage of being adaptable to any operating table, thus creating an opportunity for great economic savings in equipment.

Another object of the present invention is to provide for unlimited adjustment of the position of the patient, from a flat position such as preferred when first transferring the patient to the operating table, to a seated position as required for performing the procedure.

Yet another object of the present invention is to provide for rapid access to, and effecting of the adjustment mechanism, such that the patient can be rapidly repositioned in case of complications during the procedure.

Still another object of the present invention is to provide a rapid and convenient way of removing or placing back into position the support for the affected shoulder.

DETAILED DESCRIPTION OF THE PREFERRED EMBODIMENTS

Figure 1A:
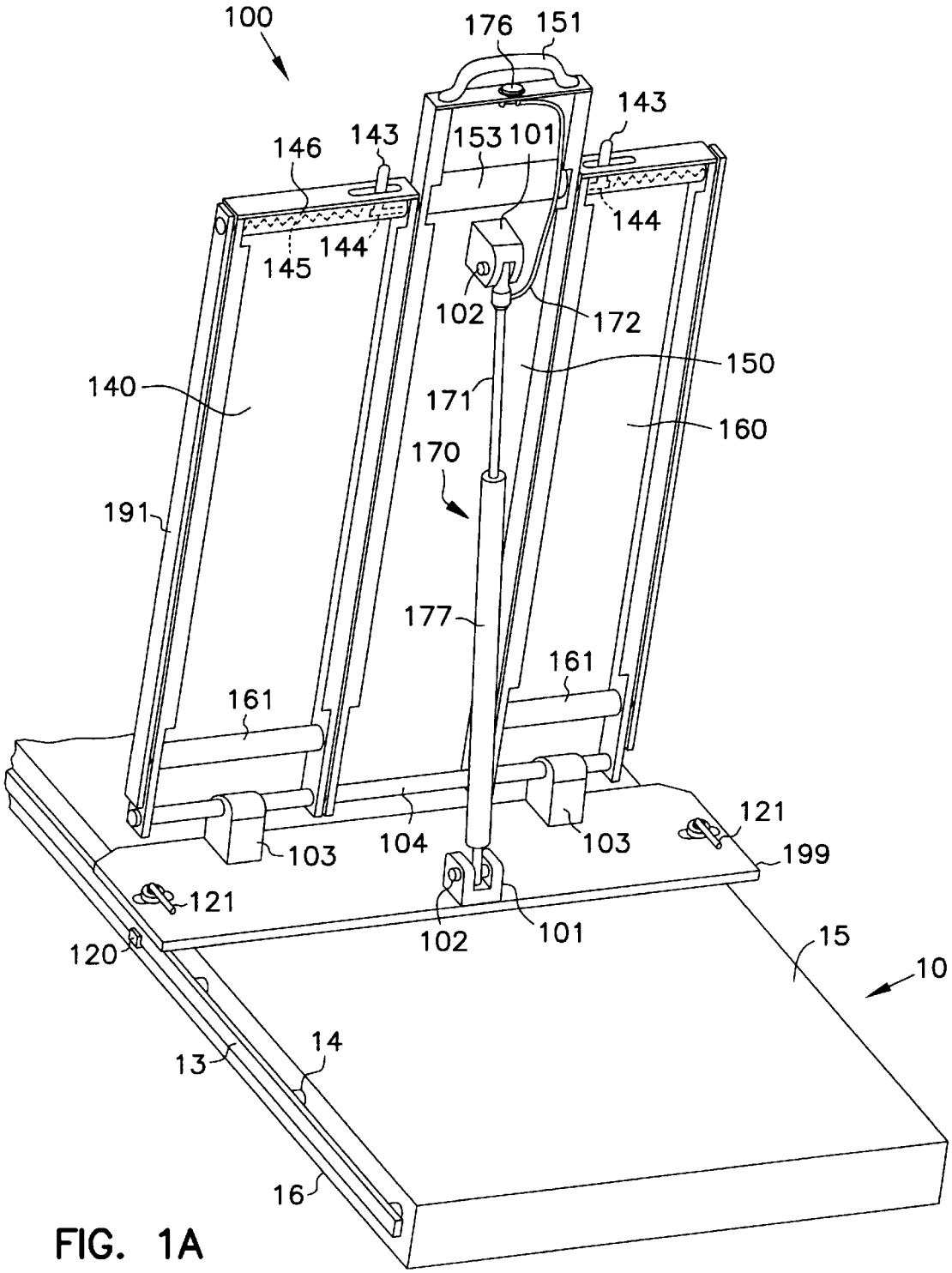
FIG. 1A is a perspective view of a first embodiment of the present invention, attached to a surgical operating table.
Figure 1B:
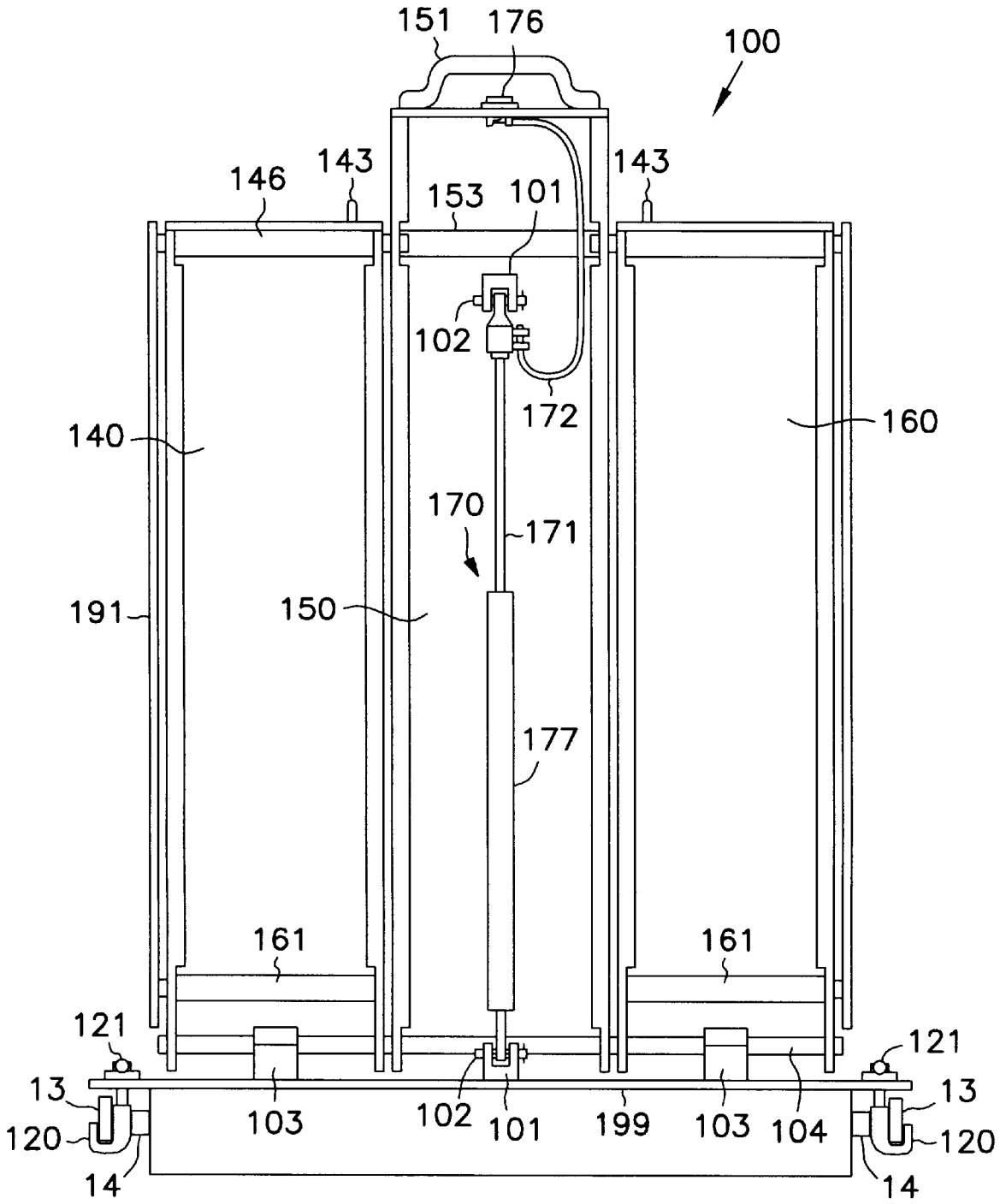
FIG. 1B is a rear view of the first embodiment of the present invention.
Figure 1C:
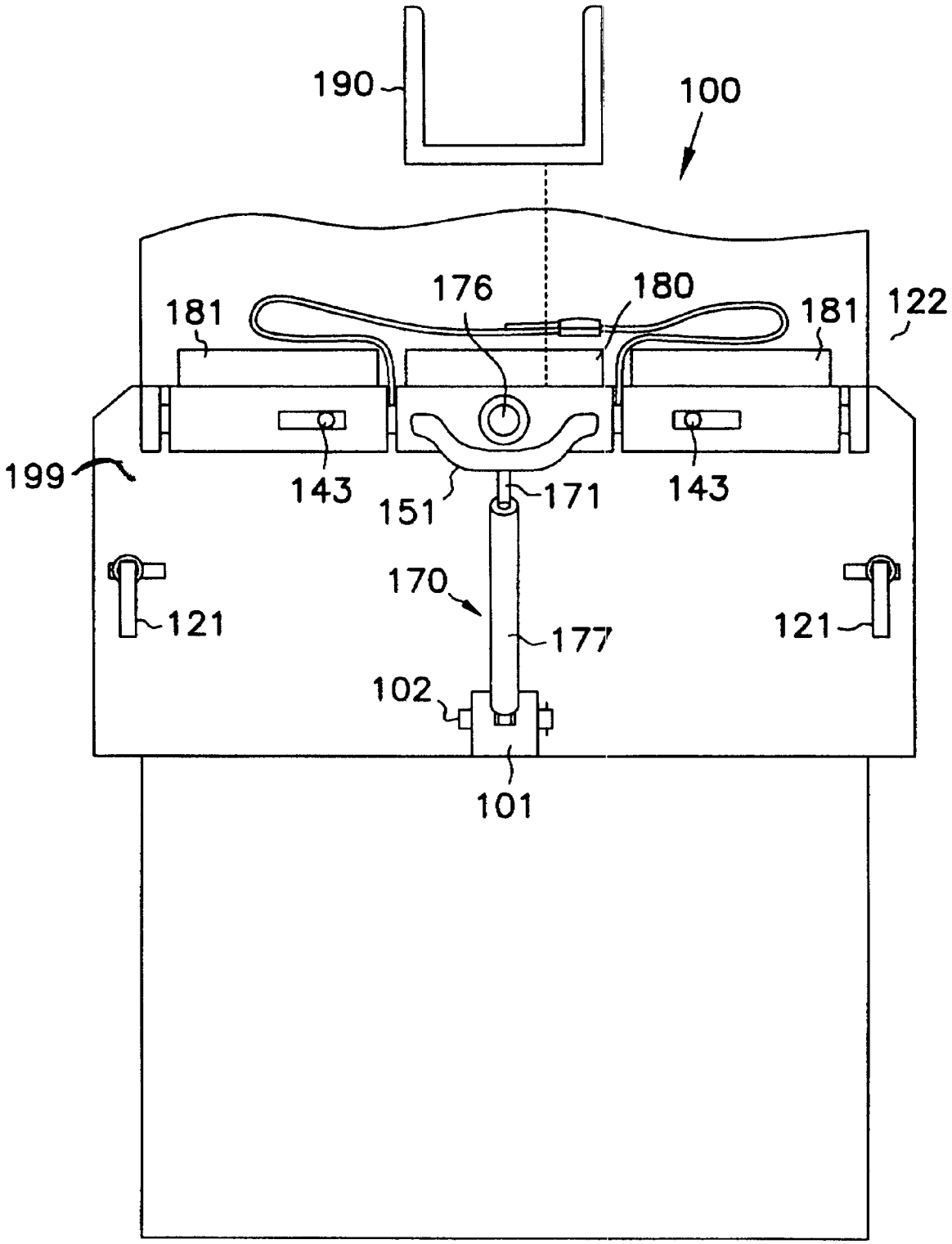
FIG. 1C is a top view of the first embodiment of the present invention in an open position.
Figure 1D:
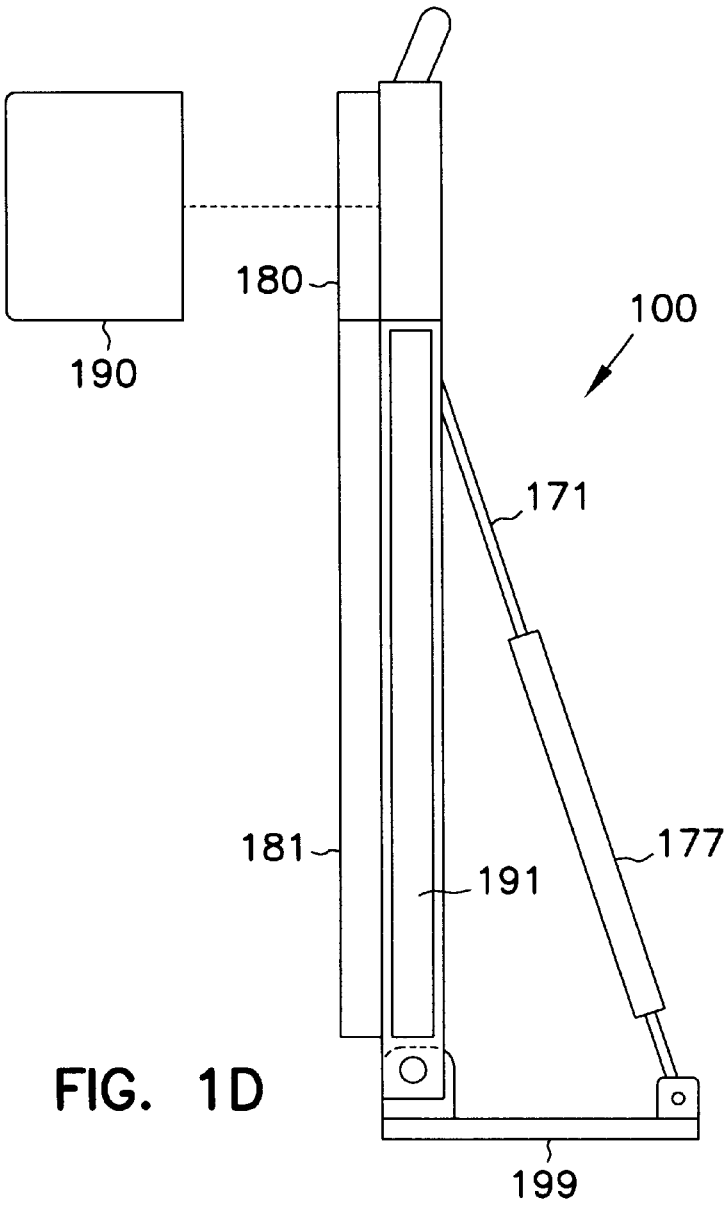
FIG. 1D is a side view of the first embodiment of the present invention in an open position.

In the following detailed description of the preferred embodiments, reference is made to the accompanying drawings that form a part hereof, and in which are shown by way of illustration specific embodiments in which the invention may be practiced. It is understood that other embodiments may be utilized and structural changes may be made without departing from the scope of the present invention.

In one embodiment of the present invention, both left-side 140 and right-side 160 sections fold on hinges, and are either: (a.) separably connected to a center section 150 and hingedly connected to the base frame 199, as shown in the first embodiment of FIGS. 1A–1E (these figures together called "FIG. 1"), or alternatively (b.) left-side 340 and right-side 360 sections are separably connected to their respective "vertical" sides of center section 350 and hingedly connected on their "horizontal" sides to the bottom of center section 350 as shown in the third embodiment of FIG. 3, or alternatively (c.) left-side 440 and right-side 460 sections are hingedly connected to their respective "vertical" sides of center section 450 and separably connected at their "horizontal" sides to the bottom of center section 450 as shown in the fourth embodiment of FIG. 4.

In yet another alternative embodiment, as shown in the second embodiment 200 of FIGS. 2A–2E (these figures together called "FIG. 2"), a side section 260 is separably attached to either or both sides of the center section 250 by a rail attaching mechanism of mounting-block sockets 251 and 252, and a corresponding C-chaped rail rod 290, and these side sections can be completely removed once the patient is raised in position.

In the first embodiment, surgical table accessory 100 (as shown in FIG. 1) includes a supporting base frame 199 that is attached to a standard surgical operating table 10 (conventional operating table 10 includes table base 16 having top surface 15, and operating table rails 13 typically bolted to table base 16 through standoff sleeves 14) via clamps 120 that affix to the operating table rails 13 and are secured, once the accessory is laterally adjusted, using clamp knobs 121. In one embodiment, clamp knobs 121 turn a threaded post attached to clamps 120 to tighten clamps 120 to rails 13. Alternatively (and not shown), the base frame can be secured to other parts of the operating table 10, such as the surface 15, the sides 16, or the rails attaching mechanism 14. Examples of such possible attachment include, but are not limited to, hook-and-loop material (such as Velcro-brand fastening tape), latches that act on the rail attachment pins 14, and lateral clamps or bolts acting on the table sides 16. In the embodiment of FIG. 1, three separate sections 140, 150 and 160, are hingedly connected to the frame 199, and each can be moved independently or in any combination, pivotally along the front edge of the base frame 199 using hinge supports 103. Each side section (140 and 160) is lockable onto center section 150 by a locking pin 144 which is spring-loaded inside tube 146 and actuated with latch handle 143. In one embodiment, each side section 140 and 160, as well as center section 150 is fabricated from a strong but light-weight sheet metal such as aluminum or stainless steel, bolted or welded together. Tubes 161 provide additional mechanical strength and rigidity to side sections 140 and 160. Locking pin 144 inserts into tube 153 located on the center section 150. Thus, initially, all three support sections 140, 150 and 160 can be joined (i.e., latched together) so as to present a singular surface that can be pivotally moved around hinge rod 104 to the desired support angle (i.e., lifted to the desired position using handle 151 and locked at that position be releasing button 176) for the surgical procedure. One or both of the side sections 140 and/or 160 may then be separated from the center support section 150 by releasing either or both, respectively, locking pins 144, and moved the side section independently out of the way, so as to give access to the side of the patient's body where the surgical procedure will be performed.

A continuously adjustable positioning mechanism 170 is used similarly in each of the embodiments of FIGS. 1–4 of the present invention to provide adjustment of the angle formed between the respective center section 150, 250, 350 or 450 and the respective base frame 199 or 299. The positioning mechanism 170 can be implemented many possible ways, e.g. with electrically or pneumatically actuated motors, a pneumatic cylinder operated from an air supply, or a manually actuated crank. Each of the shown embodiments of the present invention (i.e., FIGS. 1–4) use a gas spring 177 (shown in more detail in FIG. 5) for simplicity and low cost. A self-locking gas spring, part number 869856 made by Stabilus of 92 County Line Road, Colmar, Pa. was chosen for gas spring 177 in the embodiments shown. This spring provides counterbalancing forces, yet is self-locking for infinite resolution and precise positioning. Unlocking of the gas spring 177 is controlled by actuating a release button at the end of the rod 171. The remote control button 176 acts on such release button through a cable assembly 172 connected to a pivoting release assembly 173 which attaches to the rod 171 of the gas spring 177. This pivoting release assembly also provides a convenient attachment point for the gas spring 177. For this pivoting release assembly, we chose part number CMA 12076-10 made by Cable Manufacturing & Assembly Co. Inc., of 10896 Industrial Parkway, Bolivar, Ohio. Both the pivoting release assembly 173 and the other end of the gas cylinder 177 pivotally attach to mounting blocks 101 with clevis pins 102. In turn, the mounting blocks 101 attach, one to the center section 150, 250, 350, or 450, and another to the base frame 199.

A handle 151 is built into or attached to the center section 150, 250, 350, or 450 to provide a convenient way of adjusting (i.e., manually lifting or lowering) the center section 150, 250, 350, or 450 with respect to the support frame 199 or 299. In one embodiment, the positioning mechanism remote control button 176 is located adjacently to the handle 151 for intuitive and convenient operation of the surgical table accessory 100, 200, 300, or 400.

In one embodiment, the patient's head is secured with a head cradle 190 which attaches to the center support section 150, 250, 350, or 450 at any convenient location. In one embodiment, the head cradle 190 is made of thermally formed plastic, but practically any method of construction could be employed to provide this function. In other embodiments, other possible shapes could be considered including one where a closed loop is placed on the patient's head which is then radially adjusted to fit tightly on said patient's head. This last mentioned embodiment has the added advantage of eliminating the need for straps or other securing means.

In one embodiment, side rails 191 are attached to a side support 140 and/or 160 via connecting tubes 146 and 161, as shown in FIG. 1. In another embodiment, mounting block sockets 251 and 252 provide connection to C-shaped rail rods 290, as shown in FIG. 2. These rails provide a convenient way of supporting additional accessories such as arm support boards, surgical supplies, intravenous solution bags, etc.

For the purposes of this invention, the term operating table encompasses operating tables, operating beds, and all such similar devices.

The second embodiment of the present invention, shown in FIGS. 2A–2E, differs from the first embodiment mainly in the way the side sections are attached and the geometry of the center section. In this second embodiment, the side sections include permanent supports 239 attached to the frame 299, used to attach cushions 261 using loop and hook fastening tape, in order to support the patient when the accessory 200 is in the closed position, and portable cushioned supports 261 that attach to or remove from the accessory rails 290 once the side of the patient where the procedure will be done on is determined. The side cushioned supports 261 are removable from the permanent supports 239 and affixable (e.g., using Velcro fasteners) to the portable support 260 as desired. The side rails 290 mount to either or both sides of the center support frame 250 via mounting blocks 251 and 252 (e.g., the respective ends of side rail 290 insert or slide into the holes in mounting blocks 251 and 252). In one embodiment, base frame 299 extends the full length of the center section and attaches to the operating table via latches 120 and 121 to rail 13 which in turn attaches to the pins 14 that attach the operating table base 16. Hinges 103 and hinge rod 104 connect the base 299 to the center support section 250. In an alternate embodiment, a piano-type hinge connects base section 299 to center section 250. The lower portion of the inverted T-shaped geometry of the center section 250 provides support of the patient's pelvic area.

Figure 2A:
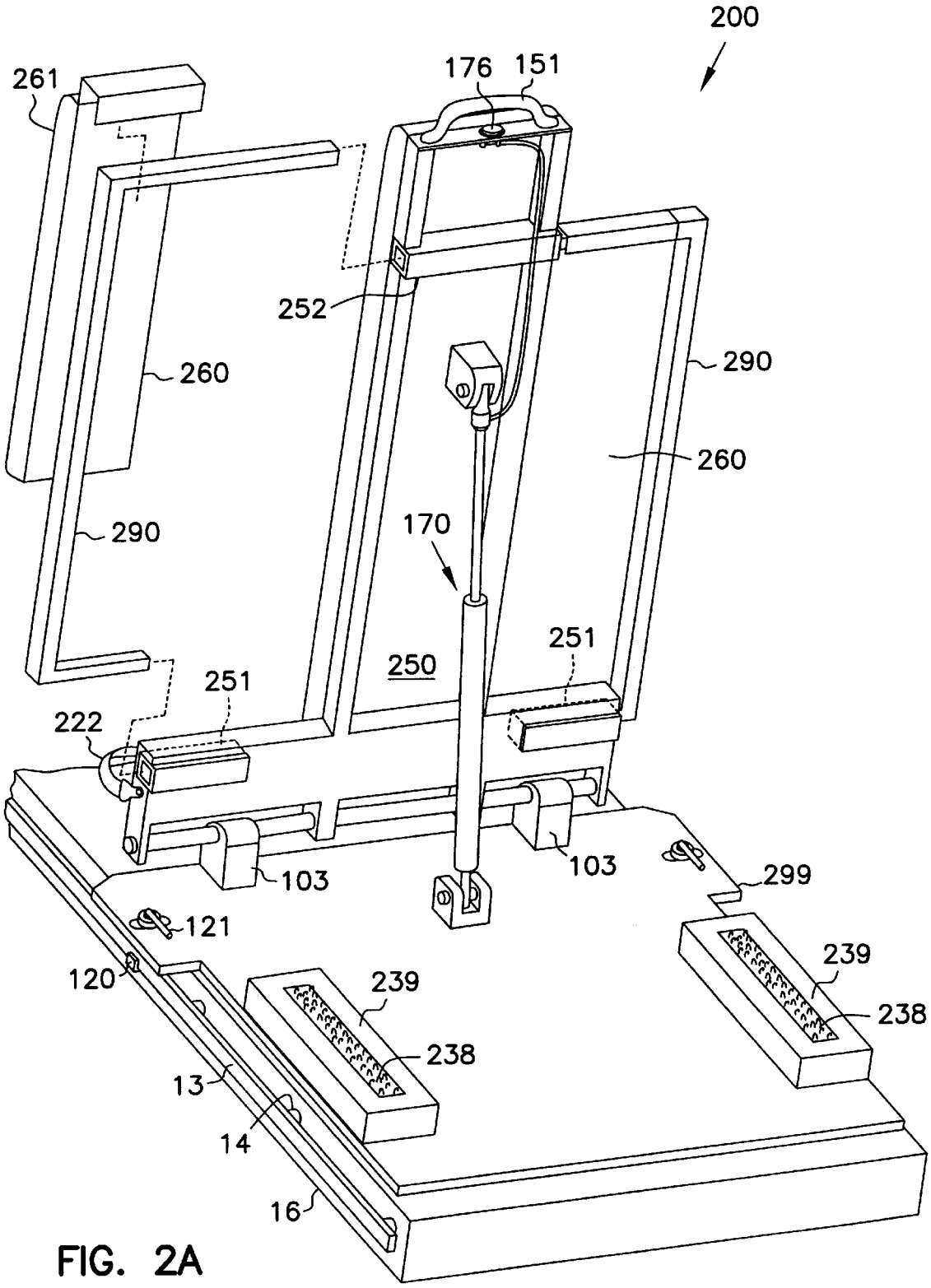
FIG. 2A is a perspective view of a second embodiment of the present invention, attached to a surgical operating table.
Figure 2B:
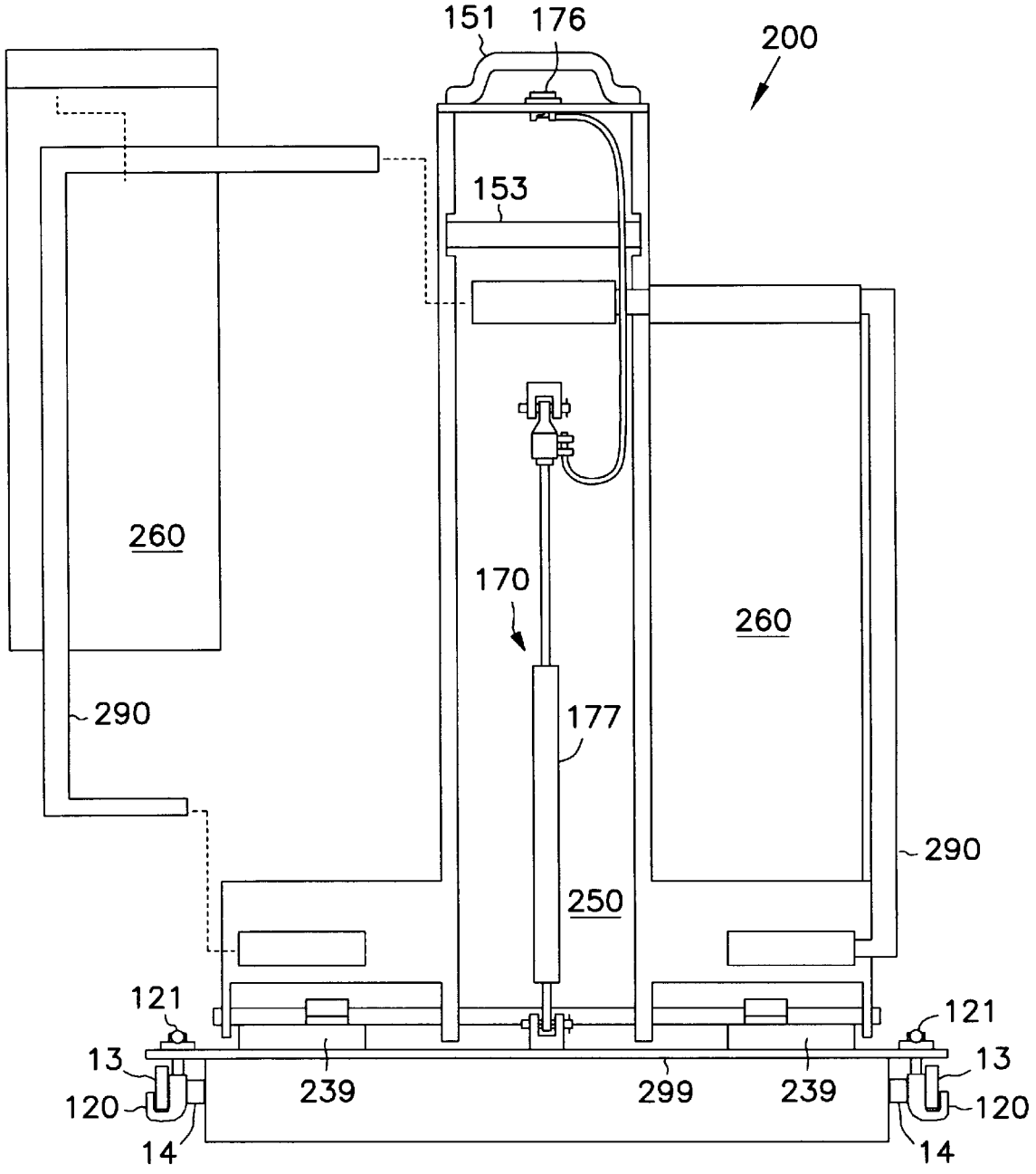
FIG. 2B is a rear view of the second embodiment of the present invention.
Figure 2C:
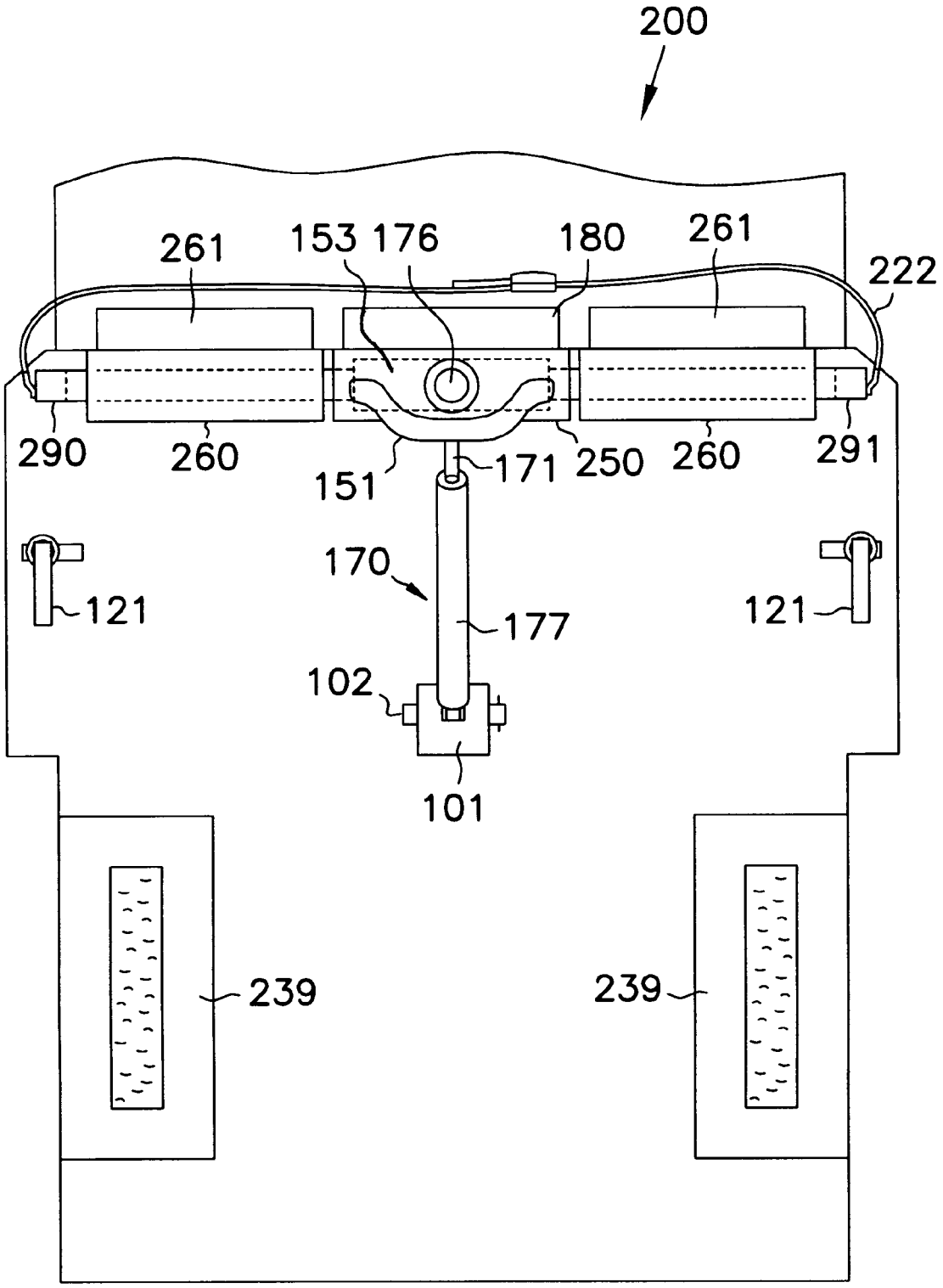
FIG. 2C is a top of the second embodiment of the present invention in an open position.
Figure 2D:
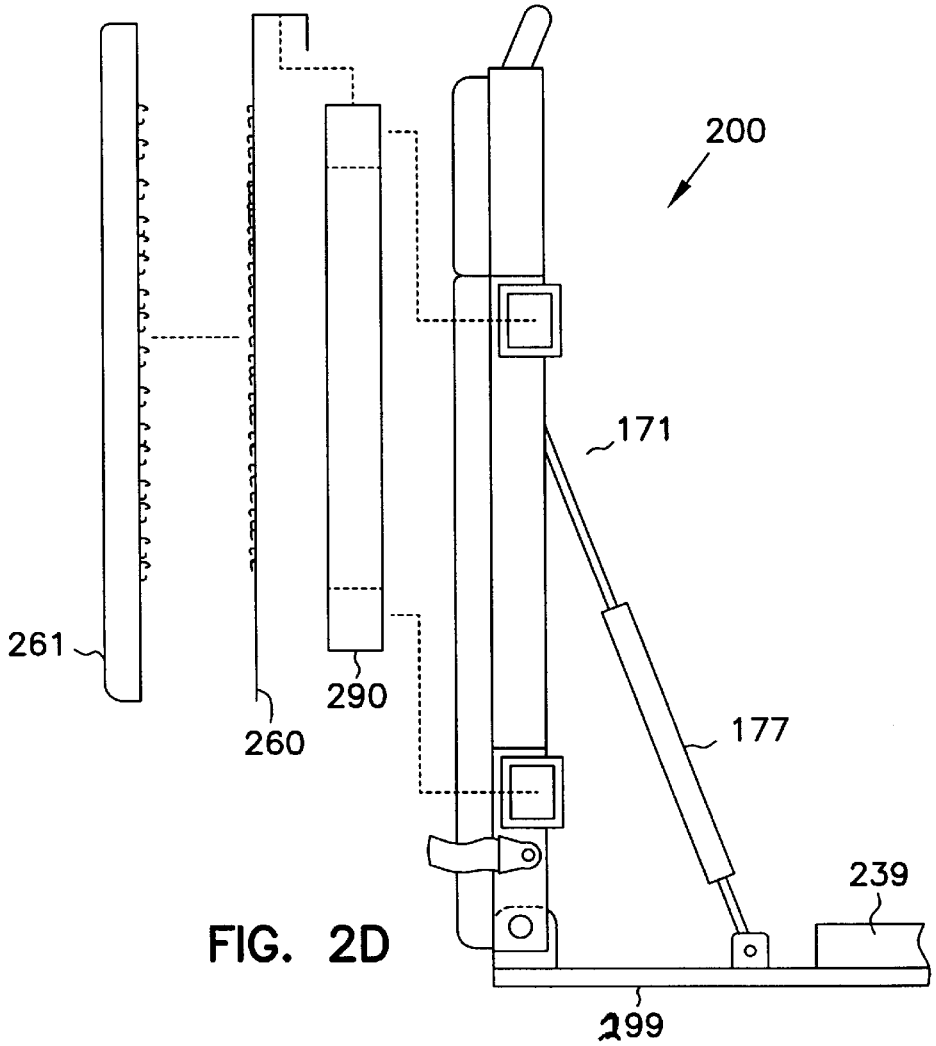
FIG. 2D is a side view of the second embodiment of the present invention in an open position.
Figure 2E:
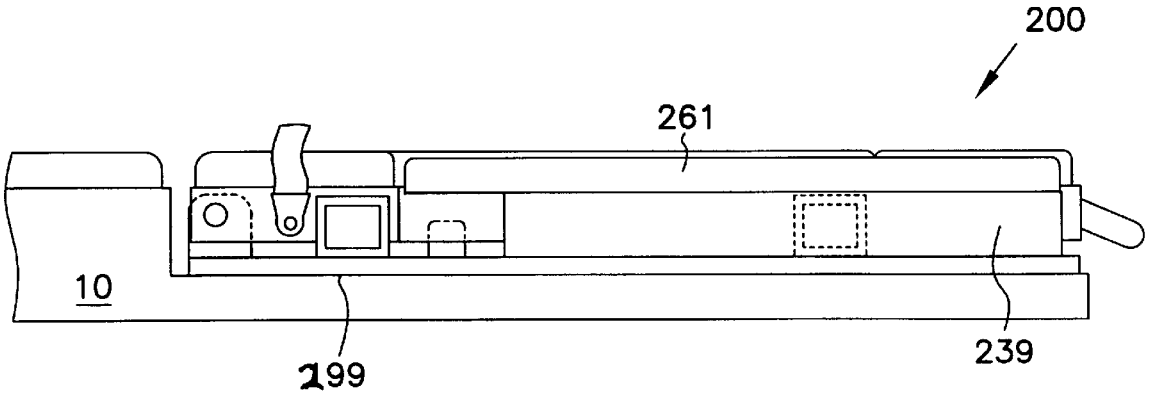
FIG. 2E is a side view of the second embodiment of the present invention, in a closed position, and shown attached to a surgical operating table.

In an operation, the embodiment of FIG. 2A typically starts in the position shown in FIG. 2E, with the center section 250 flat, and side cushions 261 attached to permanent support blocks 239 using Velcro strips 238, thus providing a substantially horizontal and substantially planar upper surface (the drawing of FIG. 2E shows—for clarity—the upper surface of cushion 261 slightly lower than the upper surface of center cushion 180, in the actual embodiment, these surfaces are substantially in the same plane). Once the patient is placed in operating table 10, the belt 222 is attached around the patient, and center section 250 is raised and locked in position using positioning device 170; side cushions 261 remain in their respective horizontal positions one blocks 239. On C-shaped side rail 290 is then inserted into mounting blocks 251 and 252 on the side not being operated on, side support section 260 is placed over this side rail 290, held in place by gravity and a friction fit of the upper U-shaped feature over the top of rail 290, and by an overlap at the sides to rail 290 and center section 250. The side cushion 261 from that side is then removed from its respective Velcro strip 238 and permanent block 239, and moved and attached to a corresponding Velcro strip on the attached side section 260 just described. No side rail 290 or side support 260 is attached to the other side, at which the operation takes place. When the operation is complete, the side rail 290, side support 260, and cushion 261 are removed, and the cushion 261 is replaced on its block 239. The center support 250 is then lowered to the horizontal position and the patient can be removed.

Figure 3:
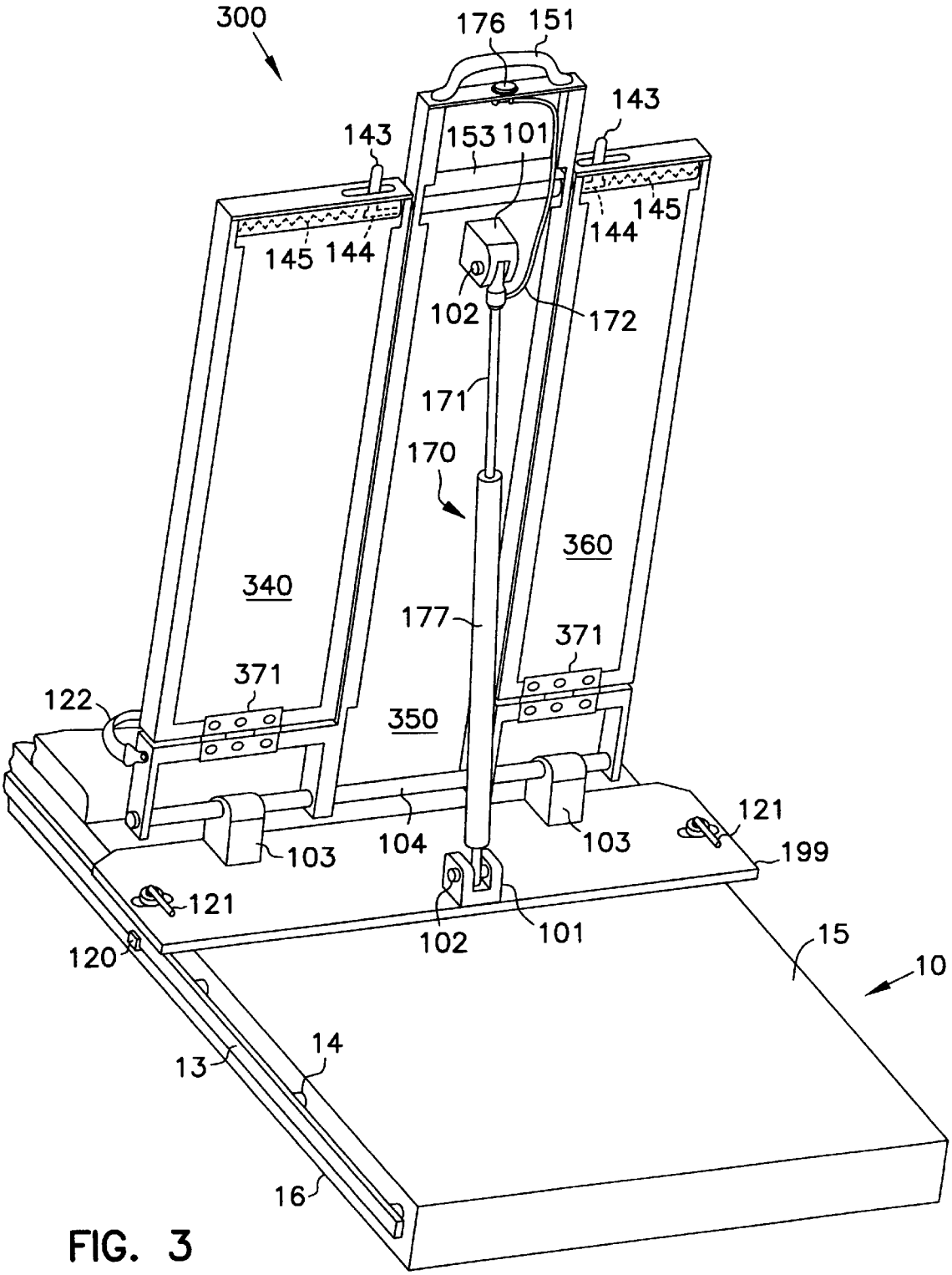
FIG. 3 is a perspective view of a third embodiment of the present invention having bottom hinges 371, attached to a surgical operating table.

FIG. 3 is a perspective view of a third embodiment of the present invention having bottom hinges 371, attached to a surgical operating table. In this embodiment, side section 340 and/or 360 are normally locked in position by locking pins 144, but once released by actuating levers 143 can be folded down, pivoting on hinges 371. The T-shaped center section 350 provides pelvic support.

Figure 4:
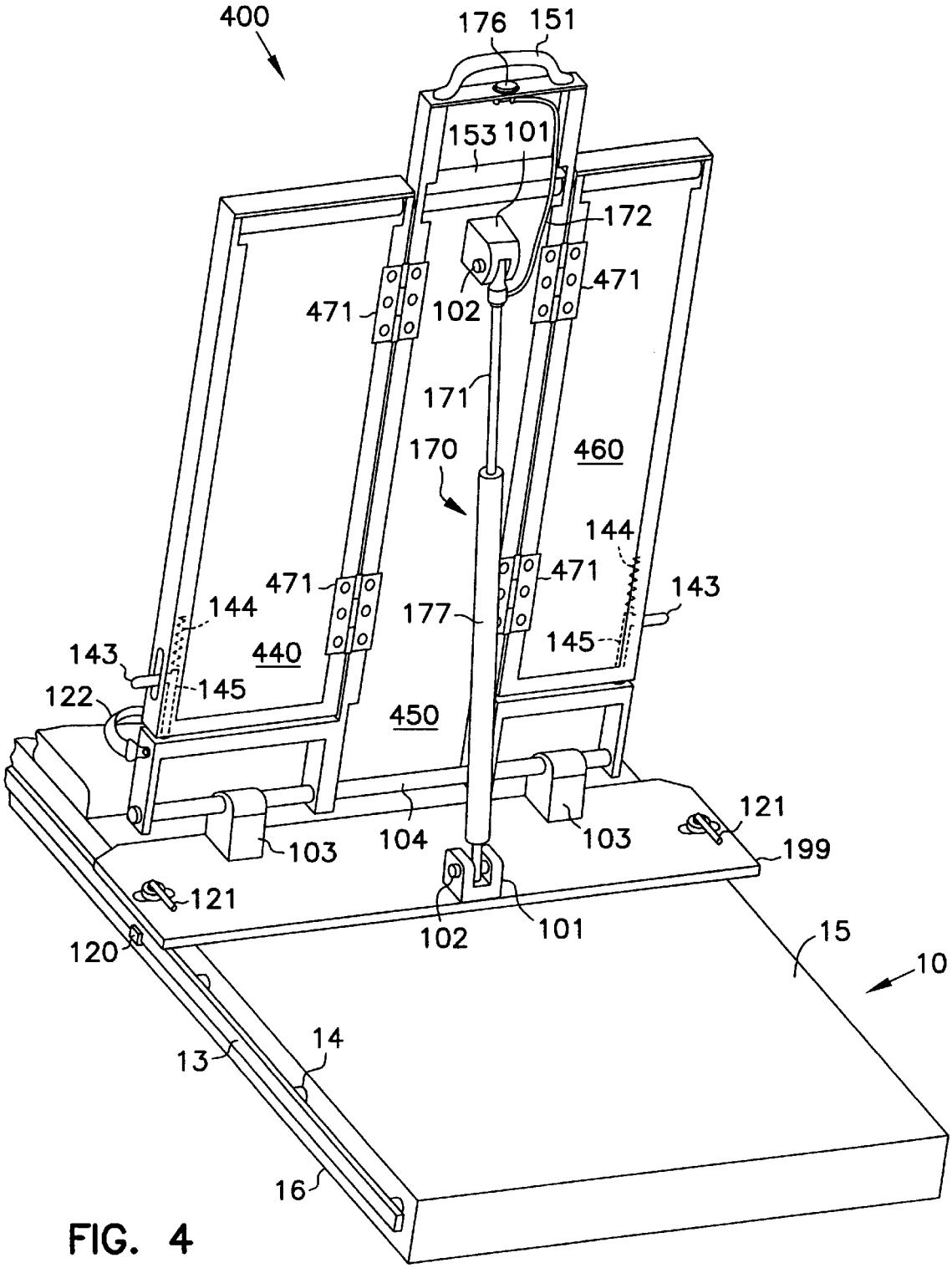
FIG. 4 is a perspective view of a fourth embodiment of the present invention having side hinges 471, attached to a surgical operating table.
Figure 5:
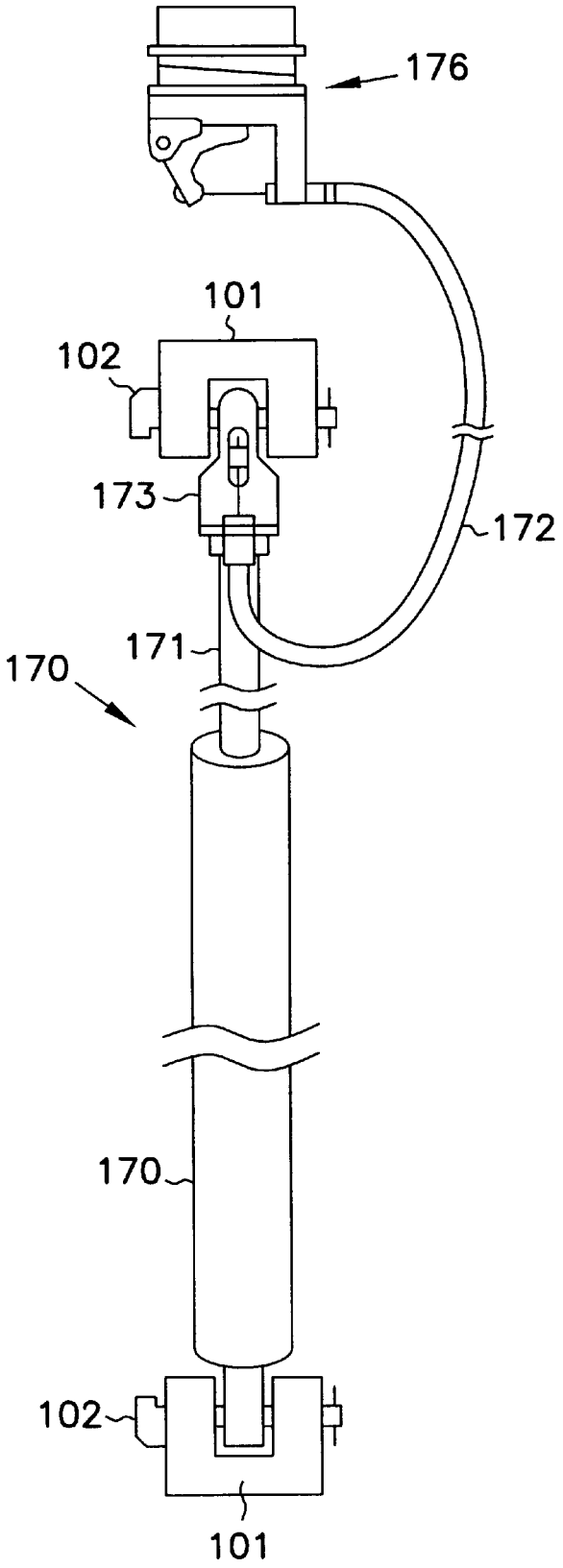
FIG. 5 is a detailed view of the positioning mechanism 170.

FIG. 4 is a perspective view of a fourth embodiment of the present invention having side hinges 471, attached to a surgical operating table. In this embodiment, side section 440 and/or 460 are normally locked in position by locking pins 144, but once released by actuating levers 143 can be folded back, pivoting on hinges 471. The T-shaped center section 450 provides pelvic support.

Figure 1E:
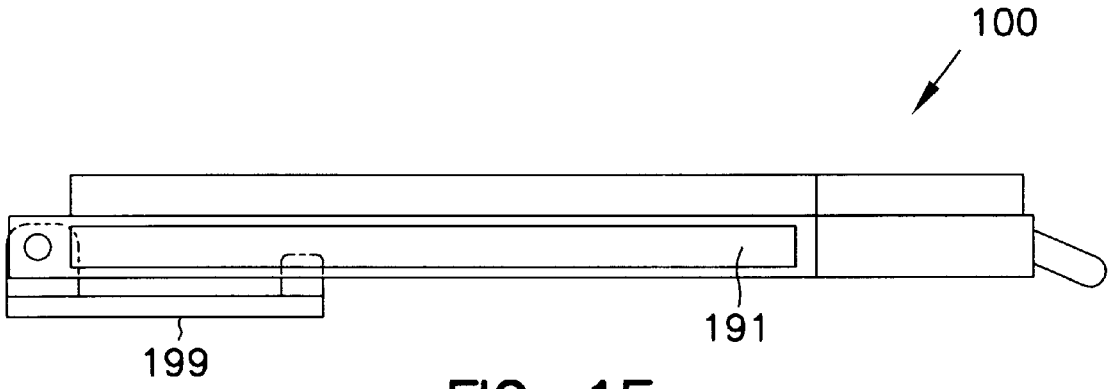
FIG. 1E is a side view of the first embodiment of the present invention in a closed position.

In an operation, the embodiments of FIGS. 1, 3, or 4 typically starts in the position shown in FIG. 1E, with the center section 150 (or 350 or 450) flat, and side sections 140 and 160 (or 340 and 360 or 440 and 460 respectively) attached to it, thus providing a substantially horizontal and substantially planar upper surface. Once the patient is placed in operating table 10, the belt 122 is attached around the patient, and center section 150 (or 350 or 450, respectively) is raised and locked in position (at any desired angle within the angular range of horizontal to vertical) using positioning device 170; side sections (e.g., 140 and 160) remain attached to the center section (e.g., 150), and thus are also raised into the same upright angle as the center section. The release lever 143 on the side section of the side to be operated on (e.g., side section 140) is then actuated to release that side section, and it is rotated about its respective hinge (e.g., hinge 103 of FIG. 1, hinge 371 of FIG. 3, or hinge 471 of FIG. 4) to a position out of the way of the operation. When the operation is complete, the side section (e.g., side section 140) is rotated back into its planar position and locked there by the respective pin. The center support (e.g., 150) is then lowered to the horizontal position and the patient can be removed.

In one embodiment, the present invention also includes center cushion 180, and side cushions 261 that are made of like appearance and construction as the cushions provided with a surgical operating table 10. When the surgical table accessory 100, 200, 300 or 400 of the present invention is in the closed position, and attached to the operating table as shown in FIG. 1E, said operating table appears unmodified. Thus, it is possible to transfer a patient to the table in a suppine position for minimum trauma to the patient and maximum convenience to the personnel effecting the transfer.

Thus, the present invention solves a number of problems in the modem hospital. By providing a continuously adjustable positioning mechanism, the surgeon is afforded more flexibility and speed in adjusting the patient prior to or during the surgical procedure. The present invention also solves the problem of economically adapting existing operating tables to perform procedures with the patient in a sitting position. Additionally, the described the surgical table accessory 100, 200, 300 or 400 does not affect normal operation of said operating table 10, and, furthermore, can be removed at will quickly and conveniently.

What is claimed is:

1. An accessory patient-positioning device (100, 200, 300, or 400) for supporting a patient on a surgical operating table (10), the surgical operating table (10) optionally including one or more operating table rails (13), the surgical operating table (10 optionally including one or more rail connecting mechanisms (14) that connect the rails (13) to the surgical operating table (10), the surgical operating table (10) having a surgical table surface (15) and one or more sides of the operating table the accessory device comprising:

a base frame (199 or 299) that is connectable to the surgical operating table (10) in a substantially horizontal plane;

a center section (150, 250, 350, or 450) hingedly connected to the base frame (199 or 299) to move between a substantially horizontal position and an inclined position such that the patient's upper torso can be raised from a supine position to an inclined sitting position;

a side section (140 or 160) movably connected to either the base frame (199) or to the center section (150), the side section movable from a first position that provides a patient-support surface of the side section substantially in a plane with a corresponding patient-support surface of the center section, to a second position that exposes a side of the patient for a surgical procedure;

a positioning mechanism (170) hingedly and pivotally connecting the center section (150) and the base frame (199) that holds the center section (150) in one of a plurality of temporarily lockable angular inclined positions within a predetermined range with respect to the base frame (199); and an attachment mechanism (120 and 121) for connecting the base frame (199) to the surgical operating table (10).

2. The accessory device of claim 1 wherein the base frame (199) is removeably connectable to the surgical operating table (10).

3. The accessory device of claim 1, wherein the attachment mechanism (120 and 121) is attachable to one or more of the operating table rails (13).

4. The accessory device of claim 1, wherein the base frame (199) is attachable to the operating table by one or more attachments to the connecting mechanism (14) of the operating table rails (13).

5. The accessory device of claim 1, wherein the base frame (199) is attachable to the operating table by one or more attachments to the surgical table surface (15).

6. The accessory device of claim 1, wherein the base frame (199) is attachable to one or more of the sides of the operating table (10).

7. The accessory device of claim 1, further comprising a side section attachment mechanism (143) that detachably joins either or both a right section (160) or a left section (140) to the center section (150).

8. The accessory device of claim 1, further comprising a head cradle (190) and head cradle attaching mechanism that affixes said head cradle to the center section (150) in one or more positions.

9. The accessory device of claim 1, further comprising cushions (180 and/or 181) attached to the center section (150), and the side section (140 or 160).

10. The accessory device of claim 1, further comprising an accessory-attachment rail mechanism (191) attached to a side section (140 and/or 160) and running parallel to an edge of the side section.

11. The accessory device of claim 1, wherein a control (176) connected to the positioning mechanism (170) allows substantially continuous adjustment of the angle of the center section (150) to the base frame (199).

12. The accessory device of claim 1, wherein the positioning mechanism (177) includes a gas spring that sets the lockable angular inclined positions.

13. The accessory device of claim 1, wherein the positioning mechanism (177) is operated from an air supply.

14. The accessory device of claim 1, wherein the positioning mechanism (177) includes an electrical motor actuator.

15. The accessory device of claim 1, wherein the positioning mechanism (177) includes a manually actuated crank.

16. The accessory device of claim 1, further comprising a mechanism (122) for securing the patient to said accessory.

17. An accessory device (200) for supporting a patient on a surgical operating table (10), the accessory device comprising:

a horizontally arrayed base frame (299) that is connectable to the surgical operating table (10) in a substantially horizontal plane;

a center section (250) hingedly connected to the base support frame (299);

a positioning mechanism (170) hingedly and pivotally connecting the center section (250) and the base frame (299) that holds such center section (250) in one of a plurality of predetermined and temporarily lockable positions with respect to the base frame (299), the positions including a substantially horizontal position and a plurality of inclined positions; and an attachment mechanism (220 and 221) adapted to attach the base frame (299) in a substantially horizontal plane to the surgical operating table (10), wherein the patient's upper torso can thereby be supported by the accessory device as the torso is raised from a supine position to an inclined sitting position by the accessory device.

18. The accessory device of claim 17, wherein the base frame (299) is removeably connectable to the surgical operating table (10).

19. The accessory device of claim 17, wherein the surgical operating table (10) includes one or more operating table rails (13) and one or more rail connecting mechanisms (14) that connect the rails (13) to the surgical operating table (10), and the attachment mechanism (220 and 221) is attachable to one or more of the operating table rails (13).

20. The accessory device of claim 17, wherein the surgical operating table (10) includes one or more operating table rails (13) and one or more rail connecting mechanisms (14) that connect the rails (13) to the surgical operating table (10), and the base frame (299) is attachable to the operating table by one or more attachments to the connecting mechanisms (14) of the operating table rails (13).

21. The accessory device of claim 17, wherein the surgical operating table (10) includes a surgical table surface (15), and the base frame (299) is attachable to the operating table by one or more attachments to the surgical table surface (15).

22. The accessory device of claim 17, wherein the surgical operating table (10) includes a surgical table surface (15) having sides of the operating table, and the base frame (299)) is attachable to one or more of the sides of the operating table.

23. The accessory device of claim 17, further comprising a mechanism (251 and 252) for attaching an accessory rail (290 or 291) to the center section (250).

24. The accessory device of claim 17, wherein a side section (260) is adapted to be removeably attached to the center section.

25. The accessory device of claim 24, further comprising a cushion (261) on the side section (250).

26. The accessory device of claim 17, further comprising permanent supports (239) on the base frame in a location corresponding to an arm of the patient and to a side of the center section and adapted to attach a cushion (261).

27. The accessory device of claim 17, further comprising a control (276) connected to the positioning mechanism that allows substantially continuous adjustment of the angle of the center section (250) to the base frame (299).

28. The accessory device of claim 17, wherein the positioning mechanism (177) includes a gas spring that sets the lockable angular inclined positions.

29. The accessory device of claim 17, wherein the positioning mechanism (177) is operated from an air supply.

30. The accessory device of claim 17, wherein the positioning mechanism (177) includes an electrical motor actuator.

31. The accessory device of claim 17, wherein the positioning mechanism (177) includes a manually actuated crank.

32. The accessory device of claim 17, further comprising a head cradle (190) and head cradle attaching mechanism that affixes said head cradle to the center support section (250) in one or more positions.

33. The accessory device of claim 17, further comprising a mechanism (122) for securing the patient to said accessory device.

34. A method for supporting a patient on a surgical table (10) for a surgical procedure on an upper torso or an upper limb of such patient, said method comprising the steps of:

providing the surgical table with an accessory device (100 or 200) to create a modified operating table that provides substantially continuously adjustable support for the patient's back, the accessory device including a movable side section and a movable center section, securing the patient to the modified operating table;

lifting the patient by pivotally raising the center section (150 or 250) of the accessory device from a substantially horizontal plane to an inclined plane relative to the surgical table in order to adjust said section so as to place the patient in a sitting position; and moving the side section so as to expose a side of the patient where the procedure is to be performed, wherein the accessory device supports the patient's non-operative side.

35. The method recited in claim 34, wherein the step of providing the surgical table with an accessory device includes the step of clamping the accessory device (100 or 200) to one or more of the rails (13) of the surgical table (10).

36. The method recited in claim 34, wherein the step of providing the surgical table with an accessory device includes the step of clamping the accessory device (100 or 200) to one or more of the mechanisms (14) that attach the rails (13) to the surgical table (10).

37. The method recited in claim 34, wherein the step of providing the surgical table with an accessory device includes the step of attaching the accessory device (100 or 200) to one or more of the sides (16) of the surgical table (10).

38. The method recited in claim 34, wherein the step of providing the surgical table with an accessory device includes the step of affixing the accessory device (100 or 200) to the surface (15) of the surgical table (10).

39. The method recited in claim 34, further comprising the step of providing a head support cradle (190) affixed to the center support section and adjusting said head support cradle (190) to one of a plurality of positions.

40. A surgical operating apparatus for supporting a patient during a surgical procedure, the apparatus comprising:

a surgical operating table;

a center section hingedly coupled to the surgical operating table and pivotally movable between a substantially horizontal position and an inclined position such that the patient's upper torso can be supported by the center section during lifting the patient from a supine position to an inclined sitting position;

a side section movably coupled to the center section, the side section movable from a first position that provides a patient-support surface of the side section rigidly coupled to the center section substantially in a plane with a corresponding patient-support surface of the center section, to a second position that exposes a side of the patient for the surgical procedure; and a positioning mechanism hingedly and pivotally connecting the center section to the surgical operating table that holds the center section in one of a plurality of temporarily lockable and angularly inclined positions with respect to the surgical operating table.

41. The accessory device of claim 17, wherein the center section is shaped to support a central portion of the patient's back and to provide posterior access to the patient's shoulder for a surgical procedure when raised to the inclined position.

* * * * *

UNITED STATES PATENT AND TRADEMARK OFFICE

CERTIFICATE OF CORRECTION

PATENT NO.:5,926,876

DATED: Jul. 27, 1999

INVENTOR(S) : Haigh et al

It is certified that error appears in the above-identified patent and that said Letters Patent is hereby corrected as shown below:

In column 6 line 26 delete "one" and insert--on--, therefore.

In column 7 line 21 delete "modem and insert--modern--, therefore.

Signed and Sealed this

Eighteenth Day of April, 2000

*Attest:*

Q. TODD DICKINSON

*Attesting Officer*

*Director of Patents and Trademarks*